US007410521B2

(12) United States Patent
Sellers et al.

(10) Patent No.: US 7,410,521 B2
(45) Date of Patent: Aug. 12, 2008

(54) FILTER SERVICE SYSTEM AND METHOD

(75) Inventors: Cheryl L. Sellers, Peoria, IL (US); Orlando Sellers, II, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 484 days.

(21) Appl. No.: 11/067,009

(22) Filed: Feb. 28, 2005

(65) Prior Publication Data

US 2006/0191246 A1 Aug. 31, 2006

(51) Int. Cl.
*B01D 46/00* (2006.01)
*F01N 3/023* (2006.01)

(52) U.S. Cl. ..... 55/523; 55/283; 55/288; 55/289; 55/302; 55/385.3; 55/DIG. 30; 95/279; 95/280; 60/311

(58) Field of Classification Search ..... 55/282.2, 55/282.3, 283, 284, 385.3, 285, 286, 287, 55/288, 289, 290, 302, 523, 524, DIG. 10, 55/DIG. 30; 95/273, 278, 279, 280; 60/311
See application file for complete search history.

(56) References Cited

U.S. PATENT DOCUMENTS 2,980,207 A * 4/1961 Allen ..... 55/283
3,615,248 A * 10/1971 Holler ..... 55/523
3,887,341 A 6/1975 Sutter
4,133,657 A * 1/1979 Krogsrud ..... 55/523
4,276,066 A * 6/1981 Bly et al. ..... 55/523
4,516,990 A 5/1985 Erdmannsdörfer et al.
4,641,496 A * 2/1987 Wade ..... 55/283
4,833,883 A 5/1989 Oda et al.
4,864,821 A 9/1989 Hoch
4,875,335 A 10/1989 Arai et al.
4,875,336 A 10/1989 Hayashi et al.
4,925,463 A * 5/1990 Kuhnert ..... 55/523
5,013,340 A * 5/1991 Taslim et al. ..... 55/523
5,019,142 A 5/1991 Waschkuttis
5,065,574 A * 11/1991 Bailey ..... 55/DIG. 30
5,123,243 A 6/1992 Baddour (Continued)

FOREIGN PATENT DOCUMENTS

EP 0 230 140 A1 7/1987

(Continued)

OTHER PUBLICATIONS

CombiClean™ Environmentally-friendly filter cleaning (2 pages) (www.lubrizol.com/enginecontrol) Visited Jul. 13, 2004.

(Continued)

*Primary Examiner*—Jason M Greene
(74) *Attorney, Agent, or Firm*—Finnegan, Henderson, Farabow, Garrett & Dunner

(57) ABSTRACT

A system for removing matter from a filtering device includes a flow receiving device having a plurality of blocking portions. Each of the plurality of blocking portions is configured to substantially block a flow directed by a corresponding at least one of a plurality of filter passages of the filtering device. The system further includes a positioning assembly configured to assist in positioning the flow receiving device within the filtering device and relative to a filter media of the filtering device.

34 Claims, 6 Drawing Sheets

U.S. PATENT DOCUMENTS

| | | | | |
|---|---|---|---|---|
| 5,253,476 | A | 10/1993 | Levendis et al. | |
| 5,254,144 | A | 10/1993 | Provol | |
| 5,390,492 | A | 2/1995 | Levendis | |
| 5,397,550 | A | 3/1995 | Marino, Jr. | |
| 5,566,545 | A | 10/1996 | Hijikata et al. | |
| 5,592,925 | A | 1/1997 | Machida et al. | |
| 5,616,171 | A | 4/1997 | Barris et al. | |
| 5,634,952 | A * | 6/1997 | Kasai et al. | 55/523 |
| 5,669,365 | A | 9/1997 | Gärtner et al. | |
| 5,930,994 | A | 8/1999 | Shimato et al. | |
| 6,010,547 | A | 1/2000 | Jeong et al. | |
| 6,233,926 | B1 * | 5/2001 | Bailey et al. | 55/385.3 |
| 6,641,646 | B2 | 11/2003 | Rosenberg | |
| 6,644,023 | B2 | 11/2003 | Hirota et al. | |
| 6,755,016 | B2 | 6/2004 | Dittler et al. | |
| 6,775,973 | B2 * | 8/2004 | Liu et al. | 60/295 |
| 6,835,224 | B2 | 12/2004 | Cheng | |
| 7,025,811 | B2 * | 4/2006 | Streichsbier et al. | 95/279 |
| 7,108,739 | B2 * | 9/2006 | Iyer et al. | 55/282.3 |
| 2004/0103788 | A1 | 6/2004 | Streichsbier et al. | |
| 2004/0112218 | A1 | 6/2004 | Steiner | |
| 2004/0226290 | A1 | 11/2004 | Bailey | |

FOREIGN PATENT DOCUMENTS

| | | |
|---|---|---|
| EP | 0 930 422 A1 | 7/1999 |
| EP | 1336729 | 8/2003 |
| JP | 4-31613 | 2/1992 |
| JP | 7-54632 | 2/1995 |
| JP | 7-63038 | 3/1995 |
| WO | WO 01/65080 A1 | 9/2001 |

OTHER PUBLICATIONS

CombiClean™ Diesel Particulate Filter Cleaning Station (2 pages) (www.lubrizol.com/enginecontrol) Visited Jul. 13, 2004.

CombiClean™ Diesel Particulate Filter Cleaning System—Operating Instructions (1 page) (www.lubrizol.com/enginecontrol) Visited Jul. 13, 2004.

"Vacuum Tanks & Pumps" Domestic Corporation Marine Systems (3 pages), Mar. 2003.

"Vacuum Tank Parts List & Diagram" Domestic Corporation Marine Systems (1 page), no date.

"Piezo Technology" Piezolith 3000 document (2 pages), no date.

* cited by examiner

FILTER SERVICE SYSTEM AND METHOD

TECHNICAL FIELD

The present disclosure relates generally to a filter service system and, more particularly, to a system for removing matter from a filter.

BACKGROUND

Engines, including diesel engines, gasoline engines, natural gas engines, and other engines known in the art may exhaust a complex mixture of pollutants. The pollutants may be composed of gaseous and solid material, including particulate matter, nitrogen oxides ("NOx"), and sulfur compounds.

Due to heightened environmental concerns, engine exhaust emission standards have become increasingly stringent over the years. The amount of pollutants emitted from an engine may be regulated depending on the type, size, and/or class of engine. One method that has been implemented by engine manufacturers to comply with the regulation of particulate matter, NOx, and sulfur compounds exhausted to the environment has been to remove these pollutants from the exhaust flow of an engine with filters. However, extended use and repeated regeneration of such filters may cause the pollutants to build up in the components of the filters, thereby causing filter functionality and engine performance to decrease.

One method of removing built-up pollutants from a filter may be to remove the clogged filter from the work machine to which it is connected and direct a flow of gas through the filter in a direction that is opposite the direction of normal flow. The filter may be large, heavy, and difficult to disconnect, making it cumbersome, time consuming, and dangerous to remove the filter from the engine of the work machine for servicing.

Another method of removing matter from a filter may be to divert an exhaust flow from the clogged filter to a separate filter, without disconnecting either filter from the engine. While the exhaust flow is diverted, air may be directed through the clogged filter in a direction opposite the normal flow. Since such matter removal systems include a second filter, however, they may be larger and more costly than single filter systems.

U.S. Pat. No. 5,566,545 ("the '545 patent") teaches a system for removing particulate matter from an engine filter. In particular, the '545 patent discloses a filter connected to an engine exhaust line, a valve structure within the exhaust line, and an air feeder. When air is supplied to the filter in a reverse flow direction, the air may remove captured particulates from the filter.

Although the '545 patent may teach the removal of matter from a filter, the system described therein requires the use of a second filter during a reverse flow condition, thereby increasing the overall cost and size of the system.

Moreover, the system is not capable of supplying a negative pressure to the filter to assist in the filter cleaning process.

The present disclosure is directed to overcoming one or more of the problems set forth above.

SUMMARY OF THE INVENTION

In one embodiment of the present disclosure, a system for removing matter from a filtering device includes a flow receiving device having a plurality of blocking portions. Each of the plurality of blocking portions is configured to substantially block a flow directed by a corresponding at least one of a plurality of filter passages of the filtering device. The system further includes a positioning assembly configured to assist in positioning the flow receiving device within the filtering device and relative to a filter media of the filtering device.

In another embodiment of the present disclosure, a system for removing matter from a filtering device includes a flow receiving device disposed proximate an outlet end of the filtering device. The flow receiving device includes a plurality of channels. Each of the plurality of channels is configured to receive a flow from a corresponding one of a plurality of filter passages of the filtering device. Each corresponding one of the plurality of filter passages is substantially blocked at a front face of a filter media of the filtering device. The system further includes a positioning assembly configured to assist in positioning the flow receiving device relative to the filter media.

In yet another embodiment of the present disclosure, a method of removing matter from a filtering device includes providing a flow receiving device having a plurality of blocking portions and positioning the flow receiving device within the filtering device such that each of the plurality of blocking portions substantially blocks a flow directed by a corresponding at least one of a plurality of filter passages of the filtering device. The method further includes manipulating the flow receiving device such that each of the corresponding at least one filter passages is unblocked.

DETAILED DESCRIPTION

Exemplary embodiments of the present disclosure are illustrated in the accompanying drawings. Wherever possible, the same reference numbers will be used throughout the drawings to refer to the same or like parts.

Figure 1:
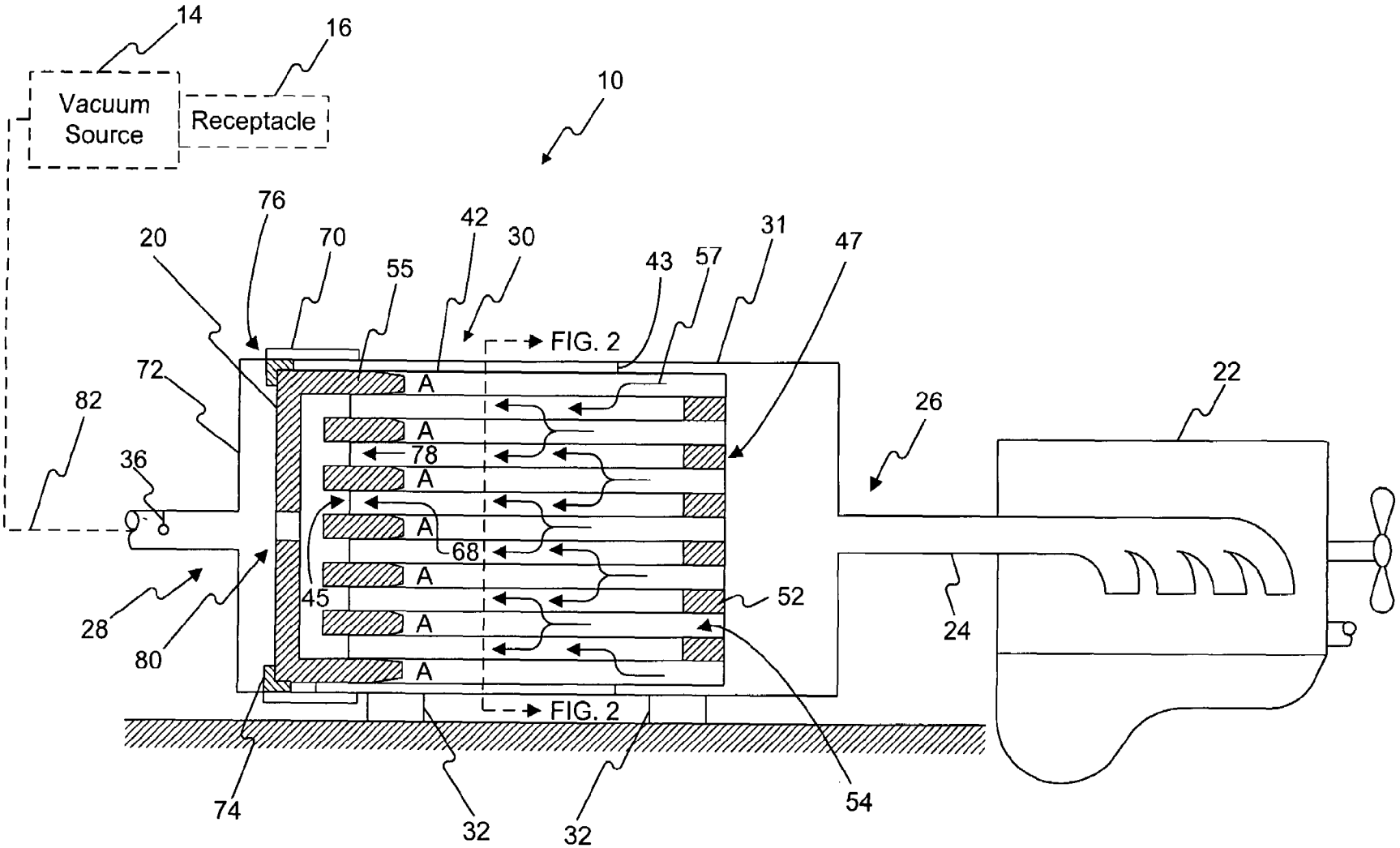
FIG. 1 is a diagrammatic illustration of a service system connected to a filter according to an exemplary embodiment of the present disclosure.

FIG. 1 illustrates an exemplary embodiment of a service system 10 connected to a filter 30. The service system 10 may include a flow receiving device 20 and a positioning assembly 76. In an exemplary embodiment, the service system 10 may further include at least one of a receptacle 16, a matter removal line 82, and a vacuum source 14. Components of the service system 10 may be operatively attached to the filter 30 for service and may be removed from the filter 30 when service is complete. A user may operatively attach and remove components of the service system 10 and may service the filter 30 without removing the filter 30 from the work machine, vehicle, or other device to which the filter 30 is attached. As used herein, the term "work machine" may include on-road vehicles, off-road vehicles, and stationary machines, such as, for example, generators and/or other exhaust-producing devices.

In some embodiments of the present disclosure, the filter 30 may be connected to an internal combustion engine 22, such as, for example, a diesel engine. The engine 22 may include an exhaust line 24 connecting an exhaust flow of the engine 22 with an inlet end 26 of the filter 30. The engine 22 may also include a turbo (not shown) connected to the exhaust line 24. In such an embodiment, the inlet end 26 of the filter 30 may be connected to an outlet of the turbo.

In some embodiments, one or more work machine diagnostic devices 36 may be disposed proximate an outlet end 28 of the filter 30. The work machine diagnostic devices 36 may be, for example, part of the work machine or other device to which the filter 30 is connected and may be external to the filter 30. Alternatively, the work machine diagnostic devices 36 may be internal to the filter 30. Work machine diagnostic devices 36 may be any sensing devices known in the art, such as, for example, flow meters, emission meters, pressure transducers, radio devices, or other sensors. Such work machine diagnostic devices 36 may sense, for example, an increase in the levels of soot, NOx, or other pollutants leaving the filter 30. The work machine diagnostic devices 36 may send pollutant-level information to a controller or other device (not shown) and may assist in, for example, triggering filter regeneration and/or filter servicing.

The filter 30 may be any type of filter known in the art, such as, for example, a foam cordierite, sintered metal, or silicon carbide type filter. As illustrated in FIG. 1, the filter 30 may include filter media 42. The filter media 42 may include any material useful in removing pollutants from an exhaust flow. In an embodiment of the present disclosure, the filter media 42 may contain catalyst materials capable of collecting, for example, soot, NOx, sulfur compounds, particulate matter, and/or other pollutants known in the art. Such catalyst materials may include, for example, alumina, platinum, rhodium, barium, cerium, and/or alkali metals, alkaline-earth metals, rare-earth metals, or combinations thereof. The filter media 42 may be situated horizontally (as shown in FIG. 1), vertically, radially, or helically. The filter media 42 may also be situated in a honeycomb, mesh, or any other configuration so as to maximize the surface area available for the filtering of pollutants.

In an exemplary embodiment, the filter media 42 may define a plurality of filter passages 54. The filter passages 54 may be arranged in any configuration known in the art. For example, the filter passages 54 may be substantially parallel channels extending in an axial direction. The filter passages 54 may be, for example, flat, cylindrical, square tube-shaped, or any other shape known in the art. The filter passages 54 may have desired porosities and/or other characteristics based on the catalyst materials of the filter media 42, and may be configured to allow, for example, gases to pass between adjacent filter passages 54 while substantially restricting the passage of, for example, pollutants. For example, exhaust gases and/or air may pass between adjacent filter passages 54 while the passage of soot, NOx, sulfur compounds, particulate matter, and/or other pollutants therebetween may be substantially restricted. The flow of such gases between adjacent filter passages 54 in a normal flow direction is illustrated by the arrows 57 in FIG. 1.

In an exemplary embodiment, a plurality of filter passages 54 may be substantially blocked or closed proximate the inlet end 26 of the filter 30 such that gas may not enter the filter passage 54 at the blocked end. The filter 30 may include a plurality of blocking apparatuses 52 configured to assist in blocking a flow of gas. In an exemplary embodiment of the present disclosure, the blocking apparatuses 52 may be plugs or other conventional blocking devices and may be formed of any metal, ceramic, or other material known in the art.

Figure 2:
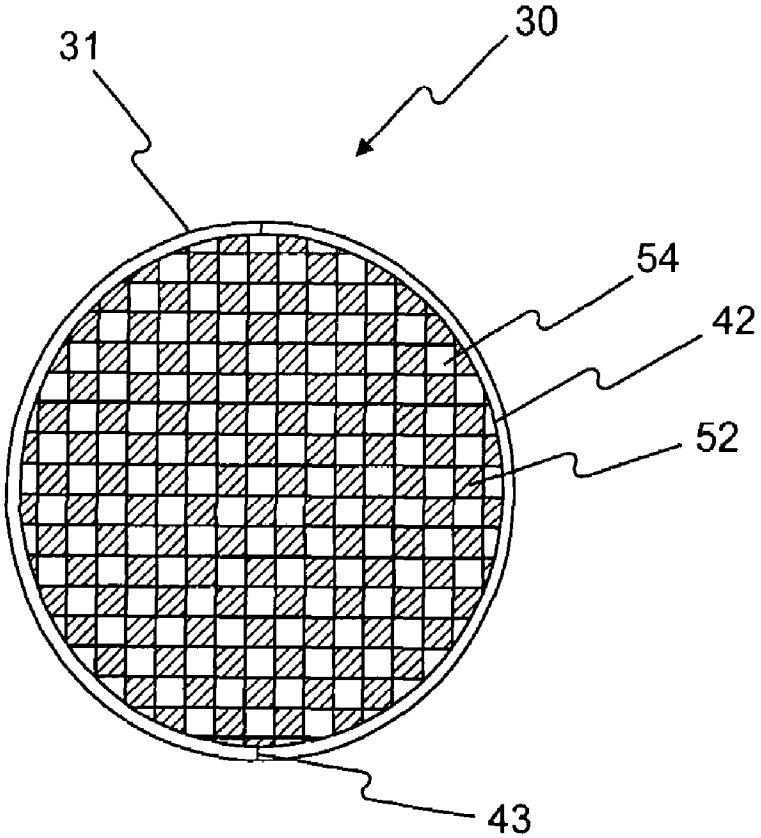
FIG. 2 is a cross-sectional view of a filter according to an exemplary embodiment of the present disclosure.

It is understood that the filter passages 54 and the blocking apparatuses 52 may be arranged in any way so as to maximize the filtering of, for example, exhaust gas. As shown in FIGS. 1 and 2, in an exemplary embodiment, the filter passages 54 and the blocking apparatuses 52 may be arranged in a substantially checkerboard-like pattern within the filter media 42. In such a configuration, adjacent filter passages 54 may be alternatively blocked by blocking apparatuses 52 at a front face 47 of the filter media 42. The front face 47 may be disposed proximate the inlet end 26 of the filter 30. As will be described in greater detail below, the flow receiving device 20 may be configured to substantially block the unblocked filter passages 54 at a rear face 45 of the filter media 42. The rear face 45 may be disposed proximate the outlet end 28 of the filter 30. This exemplary arrangement may assist in forcing exhaust gas to pass between adjacent filter passages 54 and capturing particulate matter and/or other pollutants carried by the exhaust gas along, for example, the walls of the filter passages 54.

Referring again to FIG. 1, the filter 30 may include a filter housing 31 and may be secured by any means known in the art. The filter 30 may include, for example, filter brackets 32 connected to the filter housing 31. Filter brackets 32 may be made of metal, plastic, rubber, or any other material known in the art to facilitate connecting a filter to a structure associated with the engine 22. For example, filter brackets 32 may secure the filter 30 to a work machine and may dampen the filter 30 from vibration, jarring, or sudden movements of the work machine to which the filter 30 is attached. It is understood that the filter media 42 may be secured within the filter housing 31 by any means known in the art. In an exemplary embodiment, the filter 30 may include one or more filter media supports 43 configured to secure the filter media 42 to the filter housing 31. The filter media supports 43 may also assist in sealing at least a portion of the filter 30 by substantially prohibiting a gas to pass from the inlet end 26 to the outlet end 28 without passing through a filter passage 54.

The flow receiving device 20 may be any device capable of accepting a flow of gas from a plurality of filter passages 54 and/or delivering a negative pressure in a controlled manner. The flow receiving device 20 may be, for example, a sheath, hood, disk, cartridge, nozzle, cap, or any other like device known in the art. The flow receiving device 20 may be made of, for example, plastic, polyvinyl, steel, copper, aluminum, titanium, or any other material capable of withstanding the internal operating temperatures and pressures of the filter 30.

The flow receiving device 20 may be, for example, substantially hollow, substantially cylindrical, substantially disk-shaped, and/or any other shape useful in accepting a flow of gas from the filter media 42. The flow receiving device 20 may be removably connectable to the filter 30, and at least a portion of the flow receiving device 20 may be disposed within the filter housing 31 when the service system 10 is connected to the filter 30. In an embodiment of the present disclosure, the flow receiving device 20 may be removably connected to the rear face 45 of the filter media 42 during operation of the filter 30.

Figure 3:
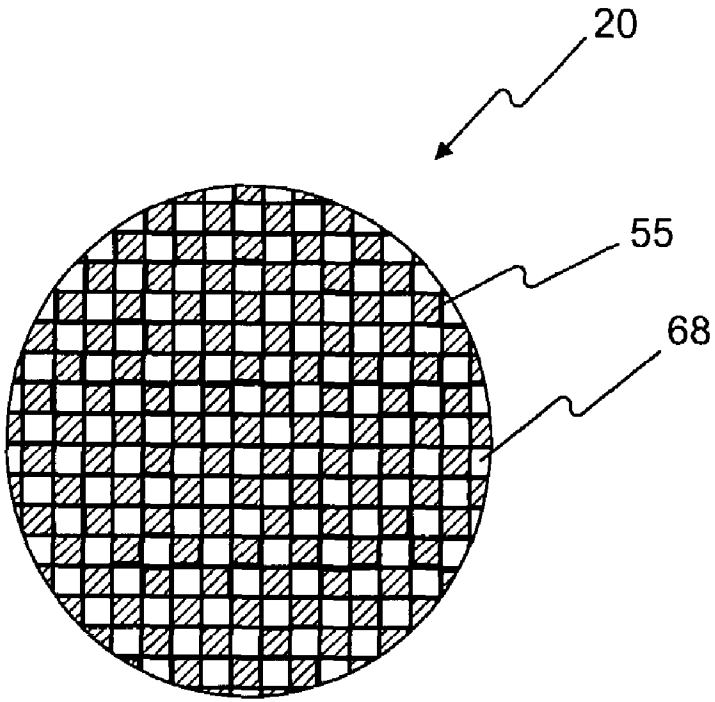
FIG. 3 is a front view of a flow receiving device according to an exemplary embodiment of the present disclosure.

As shown in FIGS. 1-3, the flow receiving device 20 may be sized, shaped, and/or otherwise configured to substantially match the dimensions and/or other configurations of the rear face 45 of the filter media 42. It is understood that the flow receiving device 20 may be positioned relative to the filter media 42 to accept a flow of gas from each of the blocked filter passages 54. The flow receiving device 20 may also be positioned to substantially block a flow directed by each of the plurality of the filter passages 54 of the filter 30. It is further understood that, as shown in FIG. 1, the rear face 45 of the filter media 42 may have substantially the same size, shape, and/or other dimensions of a cross-section of the filter media 42.

As illustrated in FIGS. 1 and 3, the flow receiving device 20 may include a plurality of blocking portions 55. Each blocking portion 55 may be sized, shaped, positioned, angled, and/or otherwise configured to substantially block a flow directed by a corresponding at least one of the plurality of filter passages 54 of the filter 30. In an exemplary embodiment of the present disclosure, at least a portion of each of the blocking portions 55 may be disposed within a corresponding one of the plurality of filter passages 54 during operation of the filter 30. In such an embodiment, the corresponding filter passage 54 may be substantially blocked by the blocking portion 55 at the rear face 45 of the filter media 42. The blocking portions 55 may be beveled, rounded, angled, and/or otherwise configured to facilitate entry into each corresponding at least one filter passage 54. In an exemplary embodiment, a lubricating material, such as, for example, silicone, may be provided to facilitate entry of the blocking portions 55 into the filter passages 54. In a further embodiment of the present disclosure, a sealing device, such as, for example, a gasket (not shown), may be provided to assist in forming a substantially airtight seal between the filter media 42 and the flow receiving device 20. When the blocking portions 55 are fully inserted into the filter passages 54, an inlet end 78 of the flow receiving device 20 may abut the rear face 45. As can be seen from FIGS. 2 and 3, in an exemplary embodiment, each of the blocking portions 55 may be sized, shaped, located, and/or otherwise configured to block a corresponding filter passage 54 that is unblocked at the front face 47 of the filter media 42. In such an embodiment, each filter passage 54 may be alternatively blocked at the front and rear faces 47, 45, and exhaust gas may be forced to pass across adjacent filter passages 54 to exit the filter 30, as shown by arrows 57.

The flow receiving device 20 may further include a plurality of channels 68. Each of the channels 68 may be sized, positioned, and/or otherwise configured to receive a flow directed by a corresponding blocked filter passage 54. In an exemplary embodiment, each channel 68 may be substantially the same size, shape, and/or configuration as a corresponding blocked filter passage 54. As discussed above, and as illustrated in FIG. 1, the blocked filter passages 54 may be blocked proximate the inlet end 26 of the filter 30. Thus, the flow receiving device 20 may be substantially aligned with the filter media 42 such that each of the channels 68 is in communication with a corresponding one of the blocked filter passages 54 during operation of the filter 30. The channels 68 may be configured to direct a flow from the inlet end 78 of the flow receiving device 20 to an outlet end 80 of the flow receiving device 20.

In an exemplary embodiment, the plurality of channels 68 of the flow receiving device 20 may be at least partially defined by the plurality of blocking portions 55. It is understood that the length and/or other dimensions of each channel 68 may be determined based on the size of the corresponding blocking portions 55 forming the channel 68. It is further understood that in an exemplary embodiment in which the blocking portions 55 form a relatively flat surface at the inlet end 78 of the flow receiving device 20, the channels 68 may be orifices defined by the substantially flat blocking portions 55.

Referring again to FIG. 1, the service system 10 may further include a positioning assembly 76 including at least one support 74 connected to a hood 72 of the filter 30. The support 74 may be of any shape, size and/or configuration known in the art, and may assist in supporting and substantially immobilizing the flow receiving device 20 with respect to the filter media 42 during operation of the filter 30. For example, the support may be a ring or a series of brackets, clamps, or other fasteners disposed about the hood 72 to secure the flow receiving device 20. The support 74 may be made of steel or any other metal or alloy capable of withstanding the temperatures and pressures associated with the filter 30, and may be rigidly mounted to the hood 72.

The hood 72 may be made from the same material as the filter housing 31 and, in an exemplary embodiment, the hood 72 may be made from the filter housing 31. The hood 72 may be sized, shaped, and/or otherwise configured to substantially seal the filter 30 during operation. The hood 72 may be removably connected to the filter 30 by any conventional means. As shown in FIG. 1, in an exemplary embodiment, a sealing device 70 may be used to removably connect the hood 72 to the filter 30. The sealing device 70 may be, for example, a bracket, compression ring, clamp, and/or other apparatus capable of forming a sealed removable connection between two structures. As shown in FIG. 1, the hood 72 and/or the support 74 may assist in forming a removable connection between the flow receiving device 20 and the filter media 42 when the sealing device 70 is engaged with, for example, the hood 72 and the filter 30. Accordingly, the sealing device 70 may be configured to assist in removably connecting the flow receiving device 20 to the filter media 42. In an exemplary embodiment, the sealing device 70 may be disposed about substantially an entire perimeter of the filter 30.

As shown in FIG. 1, a vacuum source 14 and/or a receptacle 16 may be fluidly connected to the filter 30 through a matter removal line 82, and the receptacle 16 may be configured to collect at least a portion of the matter collected by the service system 10. The receptacle 16 may be any size useful in collecting the matter removed from the filter 30 and may have any useful capacity and shape. For example, the receptacle 16 may be cylindrical or box shaped, and may be a rigid container or a flexible bag. The receptacle 16 may be designed to collect and store matter of any type or composition. In one embodiment of the present disclosure, the receptacle 16 may be designed to store harmful pollutants, such as, for example, ash, and may be made of, for example, steel, tin, reinforced cloth, aluminum, composites, ceramics, or any other material known in the art. It is understood that in an exemplary embodiment, the vacuum source 14 and the matter removal line 82 may be omitted, and the receptacle 16 may be directly connected to the filter 30.

The vacuum source 14 may include, for example, a shop vacuum, a vacuum pump, or any other device capable of creating negative pressure within another device. The vacuum source 14 may be of any power or capacity useful in cleaning the filter 30, and its size may be limited by the size and/or type of filter 30 being cleaned. For example, a filter 30 including cordierite blocking apparatuses 52 may not be capable of withstanding a negative pressure of greater than approximately 1 psi without sustaining damage to the blocking apparatuses 52 and/or other filter media 42. Thus, a vacuum source 14 used to clean such a filter 30 may have a maximum capacity that is less than approximately 1 psi. In some embodiments of the present disclosure, the vacuum source 14 may supply a constant vacuum to, and thereby create a constant negative pressure within, the filter 30. Alternatively, the vacuum source 14 may supply a pulsed or varying vacuum to the filter 30. The consistency of the vacuum supplied to the filter 30 may vary with each application and may depend on the structure, design, type, and/or other characteristics of the filter 30.

It is understood that the matter removal line 82 may connect the vacuum source 14 to the flow receiving device 20. This fluid connection may allow a solid, liquid, or gas to pass from the filter 30 and through the flow receiving device 20. It is understood that the fluid connection may permit ash or other matter released from the filter media 42 to pass from the filter 30 to the vacuum source 14 and/or to the receptacle 16. The matter removal line 82 may be any type of vacuum line known in the art. The matter removal line 82 may be as short as possible to facilitate operation of the service system 10 and to reduce the pressure drop between, for example, the vacuum source 14 and the filter 30. It is understood that the matter removal line 82 may be rigid or flexible.

In an exemplary embodiment, such as the embodiment illustrated in FIG. 1, the flow receiving device 20 may be removed from the filter 30 when the receptacle 16 is fluidly connected thereto. Removing the flow receiving device 20 may unblock a plurality of filter passages 54 at the rear face 45 of the filter media 42. Once the flow receiving device 20 is removed, a gas may be permitted to pass through the filter passages 54 without being forced to pass between or across adjacent filter passages 54. As the gas passes through the filter passages 54, the collected matter may be carried by the gas to the vacuum source 14 and/or the receptacle 16 through the matter removal line 82. As indicated by the phantom/dashed images of the vacuum source 14, the receptacle 16, and matter removal line 82 in FIG. 1, these components may not be connected to the filter 30 during operation.

Figure 4:
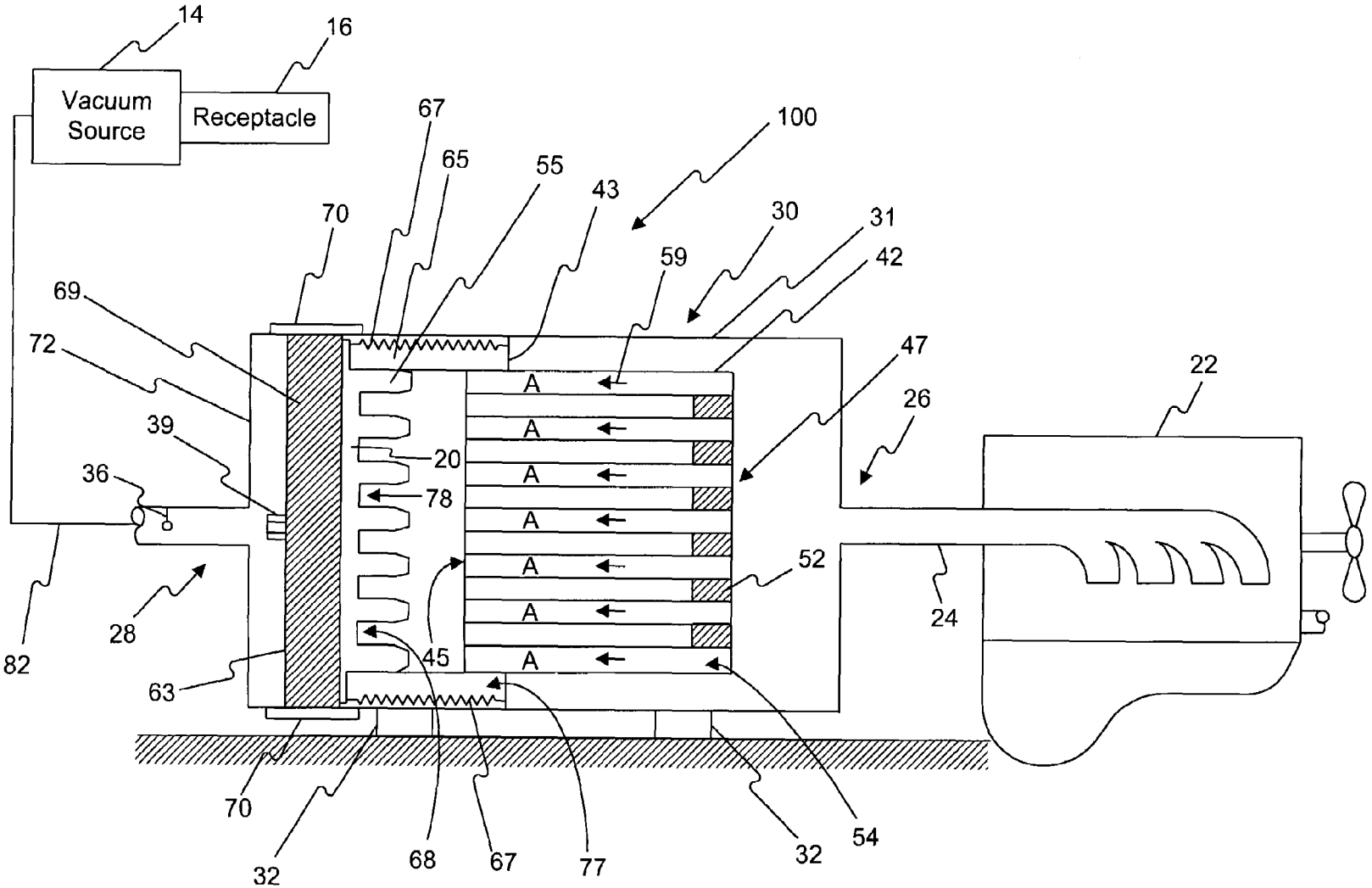
FIG. 4 is a diagrammatic illustration of a service system connected to a filter according to another exemplary embodiment of the present disclosure.

As shown in FIG. 4, in a further exemplary embodiment, a service system 100 of the present disclosure may include a flow receiving device 20, and a positioning assembly 77 including a resistance device 67 and a track 65 configured to assist in removably connecting the flow receiving device 20 to the rear face 45 of the filter media 42. The resistance device 67 may be any conventional means for providing resistance between two opposing structures, such as, for example, a spring. The resistance device 67 may provide a resistive force between any portion of the filter 30 and the flow receiving device 20. As shown in FIG. 4, the resistance device 67 may provide such force between the filter media support 43 and the flow receiving device 20. In an exemplary embodiment, the positioning assembly 77 may include more than one resistance device 67. The resistance device 67 may act on the flow receiving device 20 so as to push or draw the flow receiving device 20 toward the outlet end 28 of the filter 30, and in an exemplary embodiment, the resistance device 67 may be connected to the flow receiving device 20.

The track 65 may guide the movement of the flow receiving device 20 within the filter 30. At least a portion of the flow receiving device 20 may be disposed within the track 65, and the track 65 may be substantially aligned with the filter media 42. In an exemplary embodiment, the track 65 may govern the movement of the flow receiving device 20 such that each blocking portion 55 may be directed into a corresponding filter passage 54 when the flow receiving device 20 is moved toward the rear face 45 of the filter media 42. It is understood that the track 65 may be formed of the filter housing 31. Alternatively, the track 65 may be rigidly mounted thereto by any conventional means.

The positioning assembly 77 of the service system 100 may further include a base plate 63 having a turning device 39 and a threaded surface 69. The base plate 63 may be configured to permit flow to pass from the flow receiving device 20 to the outlet end 28 of the filter 30 substantially unrestricted. The base plate 63 may be constructed from, for example, steel, or any of the other metals and/or alloys discussed above. The threaded surface 69 of the base plate 63 may be in communication with a corresponding threaded surface (not shown) of the filter 30. The threaded surface 69 may mesh with the threaded surface of the filter 30 such that rotating the turning device 39 may change the position of the base plate 63 relative to the filter media 42. The turning device 39 may be, for example, a nut or other structure secured to the base plate 63 to facilitate movement of the base plate 63 within the filter 30. The turning device 39 may be connected to the base plate 63 through, for example, weldments or brazing. Alternatively, the turning device 39 and the base plate 63 may have a one-piece construction.

It is understood that the flow receiving device 20 may maintain constant contact with the base plate 63 as the base plate 63 moves relative to the filter media 42. The resistance device 67 may assist in maintaining this constant contact. Alternatively, the flow receiving device 20 may be rotatably connected to the base plate 63 by a bolt, screw, or other conventional means in conjunction with, for example, rotatable washers or ball bearings. In such an exemplary embodiment, the resistance device 67 may be omitted. Accordingly, movement of the base plate 63 may cause a corresponding movement of the flow receiving device 20. As described above, the movement of the flow receiving device 20 may be restricted by the track 65, thus, the flow receiving device 20 may not rotate with the base plate 63.

As illustrated in FIG. 4, when the base plate 63 and the flow receiving device 20 are positioned such that the blocking portions 55 are not disposed within the filter passages 54 at the rear face 45 of the filter media 42, a flow of gas may pass through the unblocked filter passages 54 without being forced to pass across adjacent filter passages 54. Such a flow path is shown by arrows 59. As the gas passes through the filter passages 54, collected matter may be carried by the gas to the receptacle 16 through the matter removal line 82.

Figure 5:
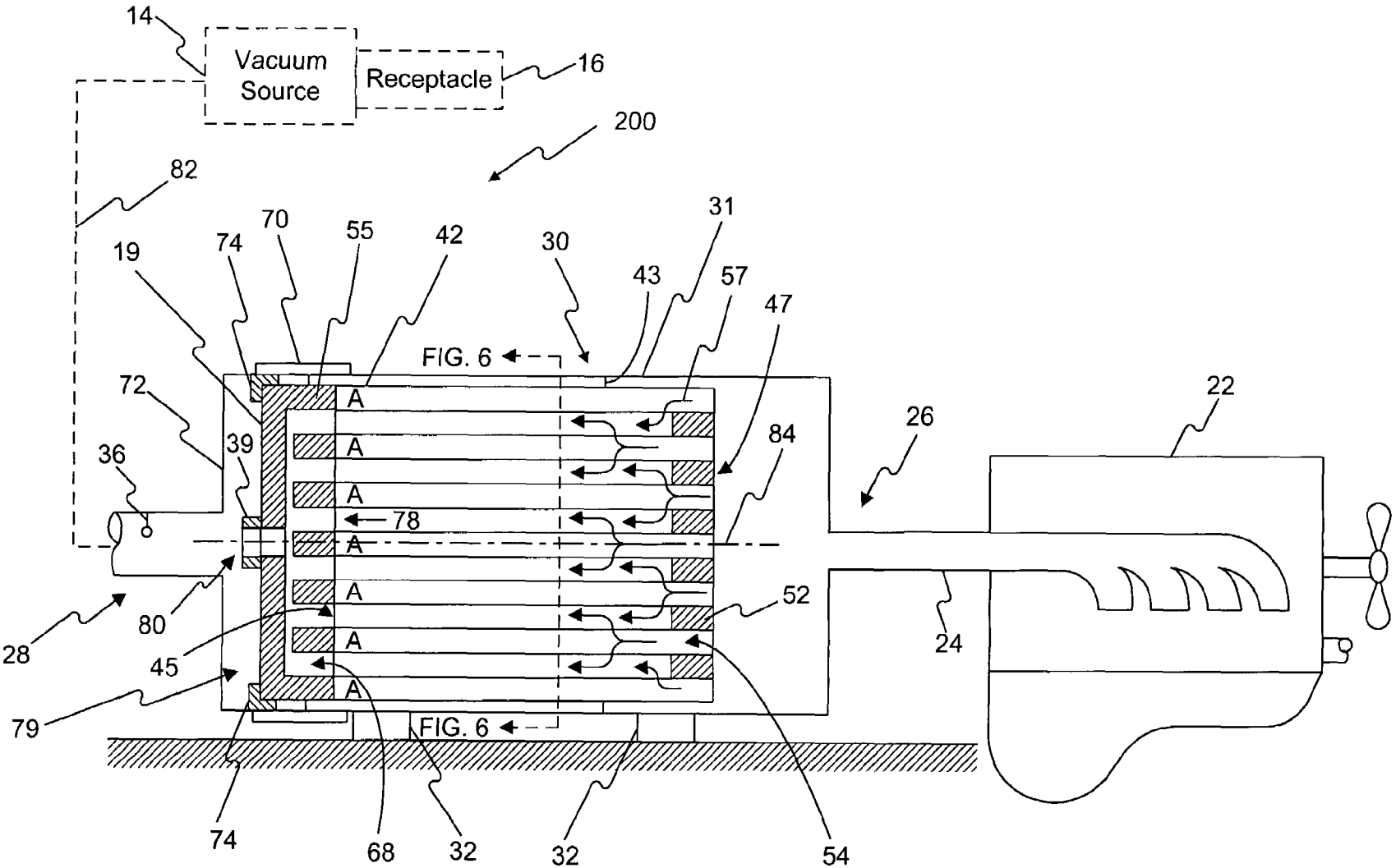
FIG. 5 is a diagrammatic illustration of a service system connected to a filter according to still another exemplary embodiment of the present disclosure.

As illustrated in FIG. 5, in still another exemplary embodiment of the present disclosure, the service system 200 may include a flow receiving device 19 having a plurality of blocking portions 55 and a positioning assembly 79. The positioning assembly 79 may include at least one support 74 connected to the hood 72 and a turning device 39 connected to the flow receiving device 19. In such an embodiment, the flow receiving device 19 may be rotatably moveable about a longitudinal axis 84 of the filter media 42 when the flow receiving device 19 is disposed within the filter 30. As discussed above, the turning device 39 may be configured to facilitate such rotation. The support 74 may assist in forming a substantially airtight seal between the flow receiving device 19 and the rear face 45 of the filter media 42. The support 74 may also include ball bearings or other conventional means to facilitate rotation of the flow receiving device 19 about the longitudinal axis 84. To further facilitate such rotation, the blocking portions 55 of the flow receiving device 19 may not be disposed within the filter passages 54 of the filter media 42. Instead, the blocking portions 55 may abut the filter passages 54 at the rear face 45 of the filter media 42. Thus, the inlet end 78 of the flow receiving device 19 may be substantially flat and/or any other shape or configuration to match the rear face 45 of the filter media 42.

Figure 6:
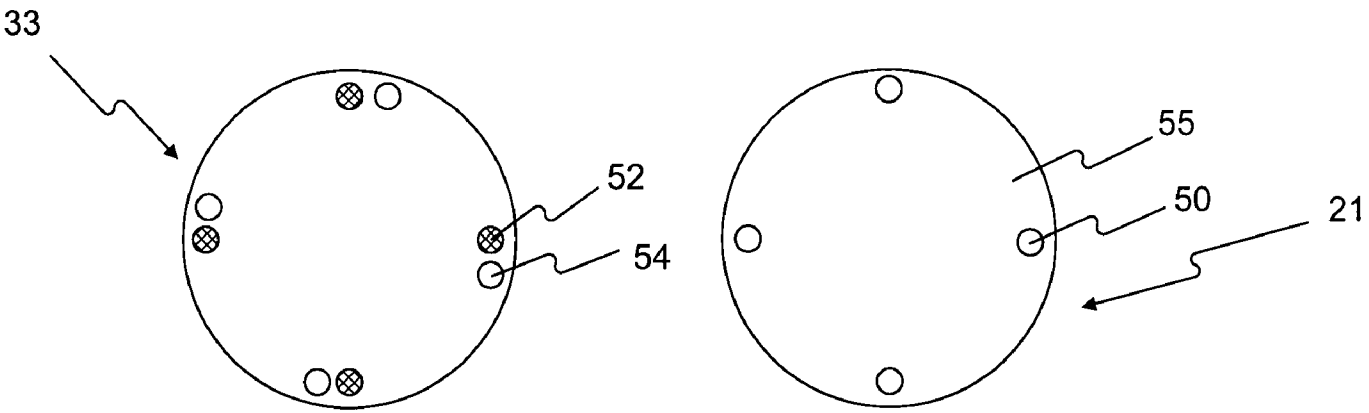
FIG. 6 is an illustration of a filter media cross-section and a corresponding flow receiving device cross-section according to another exemplary embodiment of the present disclosure.
Figure 7:
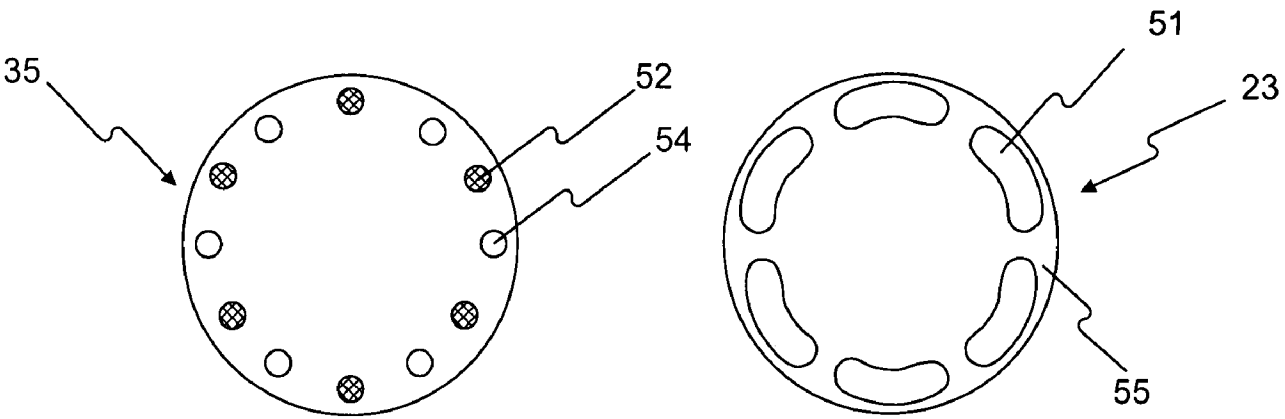
FIG. 7 is an illustration of a filter media cross-section and a corresponding flow receiving device cross-section according to yet another exemplary embodiment of the present disclosure.
Figure 8:
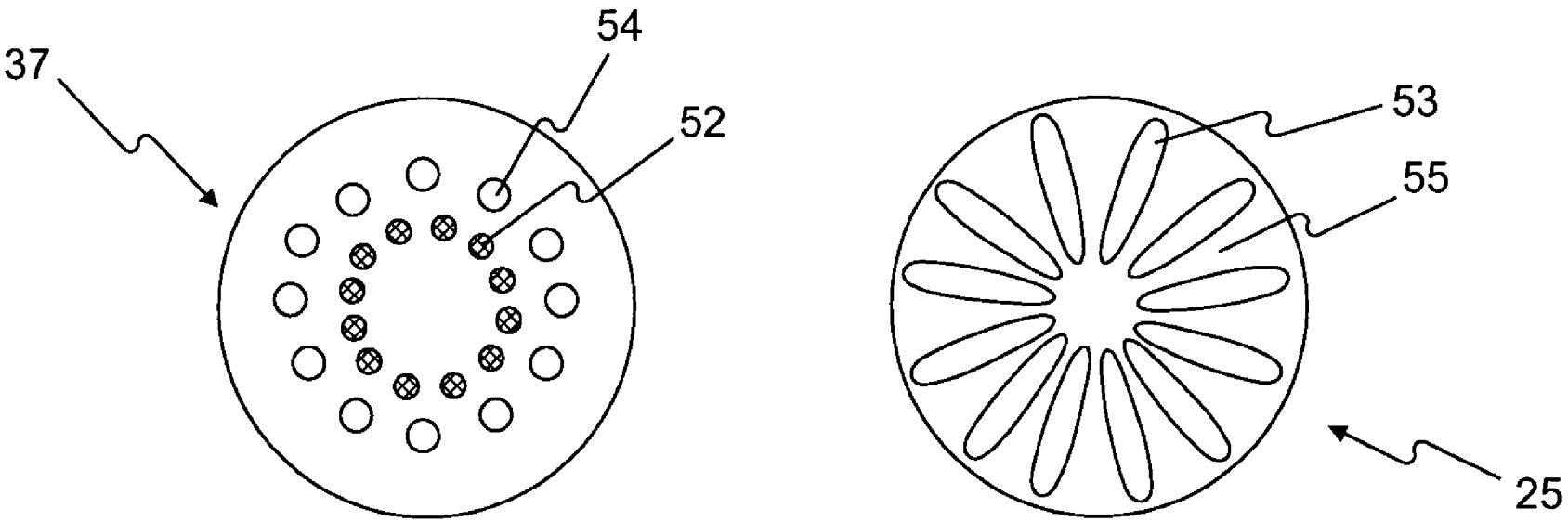
FIG. 8 is an illustration of a filter media cross-section and a corresponding flow receiving device cross-section according to still another exemplary embodiment of the present disclosure.

It is understood that each of the plurality of channels 68 of the flow receiving device 19 may be configured to receive a flow from a corresponding one of a plurality of filter passages 54, and that each corresponding one of the plurality of filter passages 54 may be substantially blocked at the inlet end 26 of the filter 30. As shown in FIGS. 6-8, the channels 50, 51, 53 may be circular, kidney-shaped, ovular, and/or any other shape known in the art. As a result, rotating the flow receiving device 19 relative to the filter media 42 may change the volume of flow exiting the filter 30. The filter 30 may be tuned for a specific application by rotating the flow receiving device 19 relative to the filter media 42. Such tuning may result in, for example, a desired flow rate through the filter 30 during operation.

INDUSTRIAL APPLICABILITY

The disclosed service system 10 may be used with any filter, filtering device, or other matter collection device known in the art. Such devices may be used in any application where the removal of matter is desired. For example, such devices may be used on diesel, gasoline, natural gas, or other combustion engines or furnaces known in the art. Thus, as discussed above, the disclosed service system 10 may be used in conjunction with any work machine, on-road vehicle, off-road vehicle, stationary machine, and/or other exhaust-producing machines to remove matter from a filtering device thereon. The service system 10 may be an on-vehicle or off-vehicle system. In embodiments where the service system 10 is an on-vehicle system, components of the service system 10 may be mounted directly to the work machine and may be removably connectable to the filtering device. For example, the service system 10 could be fixedly secured within a compartment of the work machine, such as the engine compartment. In addition, as discussed above the filter 30 may include additional upstream devices, such as, for example, catalysts and/or work machine diagnostic devices 36, within the filter housing 31. These additional upstream devices may be moved and/or removed to allow access to the filter media 42 for servicing in an on-vehicle system 10.

A variety of different methods and systems may be used to remove matter from the filtering devices of such machines. For example, some filters used in such machines may be cleaned through regeneration. During regeneration, a heater or some other heat source may be used to increase the temperature of the filter components. The heater may increase the temperature of trapped particulate matter above its combustion temperature, thereby burning away the collected particulate matter and regenerating the filter while leaving behind a small amount of ash. Although regeneration may reduce the buildup of particulate matter in the filter, repeated regeneration of the filter may result in a buildup of ash in the components of the filter over time and a corresponding deterioration in filter performance.

Unlike particulate matter, ash cannot be burned away through regeneration. Thus, in some situations, it may be necessary to remove built-up ash from an engine filter using other techniques and systems. The operation of the service system 10 will now be explained in detail.

FIG. 1 illustrates a normal operating condition for the engine 22. In this condition, the flow receiving device 20 may be disposed within the filter 30 proximate the outlet end 28, and each of the plurality of blocking portions 55 may be positioned and/or configured to substantially block a flow directed by a corresponding at least one of the plurality of filter passages 54. In addition, each of the plurality of channels 68 of the flow receiving device 20 may be positioned and/or configured to receive a flow from a corresponding one of the plurality of filter passages 54, and each corresponding one of the filter passages 54 may be substantially blocked at the front face 47 of the filter media 42. As shown in FIG. 1, positioning the flow receiving device 20 may include disposing at least a portion of each of the blocking portions 55 within a corresponding filter passage 54 during operation of the filter. It is understood, however, that in an exemplary embodiment of the present disclosure, each of the blocking portions 55 may be positioned to substantially block a flow without being disposed within the filter passages 54.

An exhaust flow may exit the engine 22 and pass through the exhaust line 24. The exhaust flow may enter the filter 30 at the inlet end 26, and may travel across at least a portion of the filter media 42. The filter passages 54 of the filter media 42 may be alternatively blocked by the blocking apparatuses 52 disposed at the front face 47 and the blocking portions 55 disposed at the rear face 45. This alternative blocking pattern may force the exhaust flow to cross adjacent filter passages 54 in order to exit the filter 30 during operation. This flow path is illustrated by arrows 57 in FIG. 1. The exhaust flow may pass through the channels 68 of the flow receiving device 20 and may exit the filter 30 at the outlet end 28.

Over time, the work machine diagnostic devices 36 may sense an increase in the amount of pollutants being released to the atmosphere. Based on these readings, the filter 30 may undergo regeneration either automatically, or as a result of some operator input. After a number of regeneration cycles, ash may begin to build up in each of the blocked filter passages 54 of the filter media 42. This built-up ash is represented by the letters A in FIG. 1. Components of the service system 10 of the present disclosure may be attached to the filter 30 to assist in removing the ash collected therein. It is understood that the service system 10 may also be used to assist in the removal of soot and/or other matter collected within the filter 30.

To begin the removal of ash from the filter 30, the engine 22 may be turned off such that combustion ceases and there is no exhaust flow from the engine 22 to the exhaust line 24. The sealing device 70 may then be loosened, opened, and/or removed such that the hood 72 may be opened and/or detached from the filter 30. Once the hood 72 is opened and/or detached, the flow receiving device 20 may be accessed. The flow receiving device 20 may be removed so that each of the corresponding at least one filter passages 54 described above may be unblocked at the rear face 45 of the filter media 42. As will be described in greater detail below, in an exemplary embodiment of the present disclosure, the filter passages 54 may be unblocked at the rear face 45 without removing the hood 72 and without removing the flow receiving device 20.

After unblocking the filter passages 54 by, for example, removing the flow receiving device 20, the receptacle 16 may be fluidly connected to the filter 30 via the matter removal line 82. It is understood that in an exemplary embodiment of the present disclosure, the outlet end 28 of the filter 30 may be disconnected from another work machine component to facilitate the connection between the matter removal line 82 and the outlet end 28. Once the receptacle 16 has been connected, the engine 22 may be turned on such that combustion is resumed and an exhaust flow travels through the filter media 42 without passing between adjacent filter passages 54. Such a flow path is illustrated by arrows 59 (FIG. 4). This exhaust flow may carry matter collected at, for example, locations A out of the filter 30. It is understood that, in an exemplary embodiment, the vacuum source 14 and/or a compressed gas source (not shown) may also be connected to the filter 30 to assist in the removal of matter. At least a portion of the matter removed by the service system 10 may be collected within the receptacle 16.

As described above with respect to FIG. 4, in an additional exemplary embodiment of the present disclosure, the motion of the flow receiving device 20 may be governed by the track 65. Thus, when the base plate 63 is rotated in, for example, a clockwise direction with respect to the filter media 42, the flow receiving device 20 may move, within the track 65, toward the rear face 45 of the filter media 42. The resistance devices 67 may be configured to apply a force opposing this motion. The turning device 39 may be used to assist in rotating the base plate 63, and a socket wrench extension or other conventional means may be inserted through, for example, the outlet end 28 to apply a rotative force to the turning device 39.

After the engine 22 is turned off, the base plate 63 may be rotated in, for example, a counter-clockwise direction with respect to the filter media 42. The flow receiving device 20 may move, within the track 65, toward the outlet end 28 of the filter 30 and may be positioned such that the blocking portions 55 are no longer blocking a flow directed by the filter passages 54. In such an embodiment, the filter passages 54 may be unblocked without removing the flow receiving device 20 from the filter 30. Thus, the flow receiving device 20 may remain disposed within the filter 30 during servicing.

After unblocking the filter passages 54, the receptacle 16 may be fluidly connected to the filter 30 via the matter removal line 82 as described above. Once the receptacle 16 has been connected, the engine 22 may be turned on such that combustion is resumed and an exhaust flow travels through the filter media 42 without passing between adjacent filter passages 54 as illustrated by arrows 59. The collected matter may pass through the channels 68 of the flow receiving device 20, and through the base plate 69, before reaching the outlet end 28. At least a portion of the matter removed by the service system 100 may be collected within the receptacle 16. As described above, a vacuum source 14, and/or a gas source (not shown) may also be connected to the filter 30 to assist in removing matter therefrom.

As described above with respect to FIG. 5, in still another exemplary embodiment, the position and relative motion of the flow receiving device 19 may be at least partially governed by the support 74. During operation of the filter 30, the flow receiving device 19 may be immobilized in the longitudinal direction with respect to the filter media 42 by the support 74 and may be positioned such that the blocking portions 55 abut the unblocked filter passages 54 at the rear face 45 of the filter media 42. In such an embodiment, the blocking portions 55 may not be disposed within the filter passages 54 during operation of the filter 30.

To begin the removal of ash from the filter 30, the engine 22 may be turned off such that combustion ceases and there is no exhaust flow from the engine 22 to the exhaust line 24. A force may be applied to the turning means 39 to rotate the flow receiving device 19 about the longitudinal axis 84. In an embodiment of the present disclosure, the flow receiving device 19 may be rotated before, during, and/or after operation of the filter 30. It is understood that rotating the flow receiving device 19 may change the volume of flow exiting the filter 30 during operation.

For example, positioning the flow receiving device 21 of FIG. 6 as shown may align the channels 50 with the blocking apparatuses 52 of the filter passages 54 (FIG. 5). Disposing the flow receiving device 21 in this position may alternatively block each of the filter passages 54 and may result in the flow path illustrated by arrows 57 (FIG. 5). Rotating the flow receiving device 21 clockwise may substantially align the channels 50 with the unblocked filter passages 54. Such a configuration may permit an exhaust flow to pass through the filter media 42 without being forced to cross adjacent filter passages 54. Such a flow path is illustrated by arrows 59 of FIG. 4.

It is understood that the flow receiving devices 19, 21, 23, 25 of FIGS. 5-8 may be rotated to any desirable position relative to the filter media 42, 33, 35, 37 during operation and/or servicing of the filter 30. Each of these different positions may result in a different volume of flow being released by the filter 30 and/or flow rate through the filter 30. The volume of flow and/or flow rate may depend on, for example, on the shape, size, and/or location of the channels 68, 50, 51, 53 and/or the shape, size, and/or location of the filter passages 54. It is further understood that each of these different positions may result in a different backpressure, aspect ratio, and/or other operating condition within the filter 30. Such conditions may be desirably chosen by the user to assist in changing the performance characteristics of, for example, the engine 22 and/or the filter. Such performance characteristics may include, for example, fuel consumption, engine temperature, and particulate filtration rate. In an exemplary embodiment of the present disclosure, the filter 30 may be tuned to minimize the backpressure therein and/or maximize the amount of soot filtered.

The user may determine whether the filter 30 is substantially free of ash by using existing work machine diagnostic devices 36, or other means known in the art. For example, after servicing the filter 30, the user may configure the flow receiving device 19 to substantially block a flow directed by the filter passages, and may start the engine 22. Work machine diagnostic devices 36 downstream of the filter 30 may determine whether the filter 30 is operating under substantially ash-free conditions or whether the filter 30 requires further service.

Other embodiments of the disclosed service system 10 will be apparent to those skilled in the art from consideration of the specification. For example, the service system 10 may include at least one sensor for sensing a characteristic of a flow through the filter 30. The sensor may be connected to a service system controller. The controller may control aspects of the ash removal process in response to signals received from the at least one sensor. To facilitate this control, components of the service system 10 may be controllably connected to the controller. It is intended that the specification and examples be considered as exemplary only, with the true scope of the invention being indicated by the following claims.

What is claimed is:

1. A system for removing matter from a filtering device, comprising:

a flow receiving device including a plurality of blocking portions and a plurality of channels, each of the plurality of blocking portions being configured to substantially block a flow directed by a corresponding at least one of a plurality of filter passages of the filtering device, each of the plurality of channels being configured to receive a flow directed by a corresponding blocked passage of the plurality of filter passages, and a positioning assembly configured to assist in positioning the flow receiving device within the filtering device and relative to a filter media of the filtering device.

2. The system of claim 1, wherein at least a portion of each of the blocking portions is disposed within the corresponding at least one filter passage during operation of the filtering device.

3. The system of claim 1, wherein each corresponding blocked passage is blocked proximate an inlet end of the filtering device.

4. The system of claim 1, wherein the plurality of channels are at least partially defined by the plurality of blocking portions.

5. The system of claim 1, wherein the flow receiving device is removably connected to a rear face of the filter media during operation of the filtering device.

6. The system of claim 5, wherein the filtering device further includes a sealing device configured to assist in removably connecting the flow receiving device to the filter media.

7. The system of claim 6, wherein the positioning assembly includes at least one support connected to a hood of the filtering device.

8. The system of claim 1, wherein the plurality of filter passages are defined by the filter media within the filtering device.

9. The system of claim 1, further including a receptacle fluidly connected to the filtering device for collecting at least a portion of the matter removed by the system.

10. The system of claim 9, wherein the flow receiving device is removed from the filtering device when the receptacle is fluidly connected thereto.

11. The system of claim 1, wherein the positioning assembly includes a resistance device and a track configured to assist in removably connecting the flow receiving device to a rear face of the filter media.

12. The system of claim 11, wherein the resistance device is a spring connected to the flow receiving device.

13. The system of claim 11, wherein the positioning assembly further includes a base plate having a turning device and a threaded surface, the threaded surface being in communication with a corresponding threaded surface of the filtering device.

14. The system of claim 1, wherein the positioning assembly further includes at least one support connected to the filtering device and a turning device connected to the flow receiving device.

15. The system of claim 1, wherein the flow receiving device is rotatably moveable about a longitudinal axis of the filter media when disposed within the filtering device.

16. The system of claim 15, wherein rotating the flow receiving device relative to the filter media changes the volume of flow exiting the filtering device.

17. The system of claim 1, further including a vacuum source fluidly connected to the filtering device.

18. The system of claim 17, wherein the vacuum source includes a vacuum pump.

19. The system of claim 1, wherein the filtering device is a particulate filter.

20. A system for removing matter from a filtering device, comprising:

a flow receiving device disposed proximate an outlet end of the filtering device and having a plurality of channels, each of the plurality of channels being configured to receive a flow from a corresponding one of a plurality of filter passages of the filtering device, each corresponding one of the plurality of filter passages being substantially blocked at a front face of a filter media of the filtering device; and a positioning assembly configured to assist in adjustably positioning the plurality of channels of the flow receiving device relative to the filter media.

21. The system of claim 20, wherein the flow receiving device further includes a plurality of blocking portions, each of the plurality of blocking portions being configured to substantially block a flow directed by a corresponding at least one of the plurality of filter passages, each corresponding one of the plurality of filter passages being substantially unblocked at an inlet end.

22. The system of claim 21, wherein at least a portion of each of the blocking portions is disposed within the corresponding at least one unblocked filter passages during operation of the filtering device.

23. The system of claim 21, wherein the plurality of channels of the flow receiving device are at least partially defined by the plurality of blocking portions.

24. The system of claim 21, wherein the flow receiving device is removably connected to a rear face of the filter media during operation of the filtering device.

25. The system of claim 20, wherein the plurality of filter passages are defined by the filter media within the filtering device.

26. The system of claim 20, wherein the flow receiving device is rotatably moveable about a longitudinal axis of the filter media when disposed within the filtering device.

27. The system of claim 26, wherein rotating the flow receiving device relative to the filter media changes the volume of flow exiting the filtering device.

28. A method of removing material from a filtering device, comprising:

providing a flow receiving device including a plurality of blocking portions;

adjusting the position of the plurality of blocking portions of the flow receiving device within the filtering device such that each of the plurality of blocking portions substantially blocks a flow directed by a corresponding at least one of a plurality of filter passages of the filtering device; and manipulating the flow receiving device such that each of the corresponding at least one filter passages is unblocked.

29. The method of claim 28, further including providing a receptacle fluidly connected to the filtering device and collecting at least a portion of the matter removed by the system within the receptacle.

30. The method of claim 28, wherein positioning the flow receiving device includes disposing at least a portion of each of the plurality of blocking portions within the corresponding filter passage during operation of the filtering device.

31. The method of claim 28, wherein at least one of positioning the flow receiving device and manipulating the flow receiving device includes rotating the flow receiving device about a longitudinal axis of a filter media of the filtering device.

32. The method of claim 31, wherein rotating the flow receiving device changes the volume of flow exiting the filtering device.

33. The method of claim 28, wherein at least one of positioning the flow receiving device and manipulating the flow receiving device includes rotating a base plate relative to the flow receiving device.

34. An engine exhaust filter system comprising:

a filter including a plurality of elongated filter passages, wherein each filter passage includes an outlet end and an unblocked inlet end and is configured to permit gas to flow through a filter passage wall;

a plurality of blocking portions having a first position in which each of the blocking portions is inserted into the outlet end of a corresponding filter passage to substantially block gas through the outlet end of each corresponding filter passage, the plurality of blocking portions have a second position in which each of the blocking portions is detached from the outlet end to permit gas flow through the outlet end of each corresponding filter passage, wherein the plurality of blocking portions are movable between the first position and the second position; and a positioning assembly configured to assist in positioning each of the plurality of blocking portions in the first position.

* * * * *